United States Patent [19]

Myers et al.

[11] Patent Number: 4,705,486

[45] Date of Patent: Nov. 10, 1987

[54] METHOD FOR MANUFACTURING A CENTER ELECTRODE FOR A SPARK PLUG

[75] Inventors: Martin G. Myers, Bowling Green; William A. Barrett, Bradner, both of Ohio

[73] Assignee: Allied Corporation, Morristown, N.J.

[21] Appl. No.: 934,512

[22] Filed: Nov. 24, 1986

[51] Int. Cl.[4] ..... H01T 21/02

[52] U.S. Cl. ..... 445/17; 228/155; 228/125

[58] Field of Search ..... 445/7; 228/155, 125, 228/156

[56] References Cited

U.S. PATENT DOCUMENTS

| | | | |
|---|---|---|---|
| 2,265,352 | 12/1941 | Corbin | 445/7 |
| 3,010,196 | 11/1961 | Smith | 445/7 |
| 3,119,944 | 1/1964 | Lentz | 445/7 |
| 3,356,882 | 12/1967 | Hallauer | 445/7 |
| 3,407,326 | 10/1968 | Romine | 445/7 |
| 3,967,149 | 6/1976 | Eaton | 445/7 |

FOREIGN PATENT DOCUMENTS

| | | | |
|---|---|---|---|
| 680374 | 10/1952 | United Kingdom | 445/7 |

*Primary Examiner*—Kurt Rowan

*Attorney, Agent, or Firm*—Leo H. McCormick, Jr.; Ken C. Decker

[57] ABSTRACT

A method of manufacturing an electrode (40) for a spark plug. A cylindrical length (10) of inconel wire has a first end (12) with a flat surface thereon. The inconel wire (10) is placed in a die and partially extruded to create a cylindrical bore (16) that extends from a second end (14) toward the first end (12). A strip of platinum (18) is welded to the flat surface (12) after which a chamfering (22) operation removes any excess platinum and weld flash to produce a cylindrical tip (18) on said first end. The inconel wire (10) with its platinum tip (18) is placed in a die and struck with a force causing the cylindrical bore (16) to be extended while the platinum flows (24) along the chamfer (22) to completely cover the weld (20). A copper core (26) is inserted in said cylindrical bore (16) and then further struck to extrude the resulting electrode (36) to a desired length.

11 Claims, 12 Drawing Figures

METHOD FOR MANUFACTURING A CENTER ELECTRODE FOR A SPARK PLUG

The invention relates to a method of making the center electrode for a spark plug.

Spark plugs are used in internal combustion engines to ignite the fuel in the combustion chamber. Hence, the electrodes of a spark plug are subject to intense heat and an extremely corrosive atmosphere. To provide some degree of longevity for the spark plug, the center electrode is made from a good heat conducting material such as copper surrounded by a jacket of a corrosion resistant material such as nickel.

The manufacture of copper and nickel electrodes for spark plugs has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 2,261,436 issued Nov. 4, 1941 and entitled "Spark Plug and Method of Making the Same" illustrates how copper and nickel is swaged into a single long wire and then cut to smaller lengths for use as electrodes in a spark plug. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps and then inserting a piece of copper wire into the cup and then lightly pressing the two materials together.

U.S. Pat. No. 3,857,145 issued Dec. 31, 1974 and entitled "Method of Producing Spark Plug Center Electrode" discloses a process whereby a copper center is inserted into a nickel member and attached thereto by a collar portion to assure that an electrical flow path is produced.

The spark plug electrodes produced by the methods disclosed above performed in a satisfactory manner when used in vehicles that were manufactured prior to the implementation of the clean air act of 1977 in the United States. After 1977, with modifications to engines and fuel, the operating temperature of most vehicles increased. As a result of the changes in the engines and fuel, some of the operating components in engines have been subjected to the corrosive effects to exhaust gases. Thus even though nickel center electrodes for spark plugs are resistant to most oxides, after a period of time of operating at higher temperatures and recirculation gases, some corrosion can occur. Once corrosion has taken place, the electrical flow path deteriorates which can result in lower fuel efficiency.

In copending U.S. patent application Ser. No. 934,514 filed Nov. 24, 1986 a method of manufacturing an electrode is disclosed wherein a platinum end cap is placed on the tip of an inconel body. Electrical current is passed through the end cap and inconel body. At the junction surface of the end cap and inconel body, an arc is formed which produces thermal energy sufficient to melt the inconel. A compressive force is applied after the current terminates to fuse the end cap with the inconel body.

The invention herein provides a method of manufacturing an electrode for a spark plug whereby a platinum tip is attached to a nickel (inconel) body in which a copper core is located. In this process, a blank is cut from a roll of inconel wire and the end face squared to produce a flat surface. A strip of platinum is welded to the flat surface and a chamfer surface is produced on the first end to remove any flash remaining from the weld and produce a platinum tip. Thereafter, the blank is placed in a die and extruded to produce a cylindrical bore. As the extrusion takes place, the platinum flows down the chamfer to completely cover the weld. A copper core is inserted in the cylindrical bore and the resulting electrode extruded to a final length. During the final extrusion, the inconel body is mechanically attached to the copper core such that there is an electrical flow path produced between the platinum tip and copper core through the inconel body.

It is an object of this invention to provide an electrode with a platinum tip which is welded to an inconel body. The platinum tip is resistant to the corrosive component in a combustion chamber and maintains an electrical flow path between a copper core and a ground. The platinum is extruded to cover the weld to assure that the flow path does not deteriorate under normal operating temperatures.

An advantage of the electrode produced from this method of manufacture occurs through the protection of the weld between a platinum tip and inconel body produced during an extrusion step whereby the platinum completely covers the weld.

These objects and advantages should be apparent from reading this specification while reviewing the drawing wherein.

Figure 1:
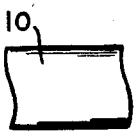
FIG. 1 is a view of a blank cut from a source of inconel wire.
Figure 2:
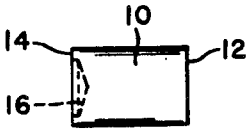
FIG. 2 is a view of the blank of inconel wire of FIG. 1 wherein the ends have been squared.

The method of manufacturing an electrode for a spark plug is illustrated by the various steps set forth in the drawings of which FIG. 1 illustrates a piece of corrosion resistant metal wire having a diameter of about 0.139"×0.2" which is cut from a spool or rod. A preferred corrosion resistant alloy is inconel which is an iron alloy containing nickel and chromium. One such inconel metal, known as Hoskins Alloy 832, contains 75% nickel, 15% chromium and 7% iron. After the wire 10 is cut into a blank as shown in FIG. 1 it is taken to a machine where the first 12 and second 14 ends are squared to define flat surfaces. At the same time, end 14 is struck to initiate an axial bore 16 as shown in FIG. 2.

Figure 3:
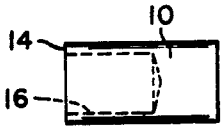
FIG. 3 is a view of the inconel blank with a cylindrical bore located therein.

Blank 10 is carried to a die as extruded to partially define a cup as shown in FIG. 3.

Before placing a piece of inconel wire 10 into a die it is coated with a standard cold heading lubricant. Such a lubricant is a lubricating oil with extreme pressure additives; sulphur, chlorine and neutral animal fat. It is most often a combination of sulphurized fat and a chlorine additive and is available from a good number of lubricant manufacturers. Lubrication is vital in cold heading to reduce die wear, promote good finishes and eliminate galling, scratching and seizing of the work piece by preventing pickups by the dye. During the cold heading operation, the sulphur and chlorine components of the lubricant form ferrous sulphides and chlorides which prevent welding of the die to the workpiece and act in the same way as a solid lubricant. An example of one such lubricating oil if TUF-DRAW I.F. 2885 made by the Franklin Oil Corporation of Ohio.

When the blank or wire 10 is removed from the die as illustrated at FIG. 3, it is carried through a cleaning solution of trichloroethane 1, 1, 1, where oils and other materials are removed from the surface and especially the surface 12 of the first end.

Figure 4:
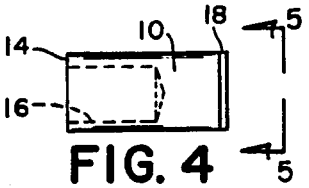
FIG. 4 is a view of the blank with a platinum strip welded to the end thereof.
Figure 5:
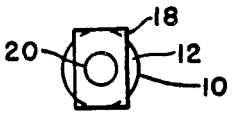
FIG. 5 is an end view of the blank and strip of FIG. 4.
Figure 6:
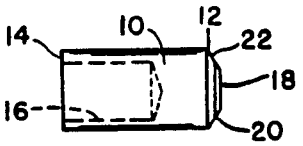
FIG. 6 is a view of the blank with a chamfer produced on the end thereof to produce a platinum tip.
Figure 7:
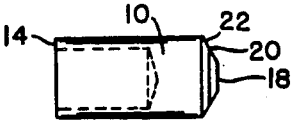
FIG. 7 is a view of the blank with the platinum tip which has been cleaned.

The blank 10 is transported to a station illustrated at FIG. 4 where a strip of platinum ribbon 18 having dimensions of 0.006"×0.1"×0.15" is welded to the flat surface of end 12. As shown in FIG. 5, the weld 20 is located on the axial center of the blank or wire 10. Thereafter, blank 10 is transported to a station where a chamfer 22 is placed on end 12 to remove the excess platinum and any weld flash that may have been produced to produce the blank 10 as shown in FIG. 6. In this state, the platinum ribbon 18 forms a tip on the end of the blank 10. Thereafter blank 10 is cleaned in a solution of trichloroethane 1, 1, 1 to remove any contamination that may remain after the chamfering operating and heading lubricant applied thereto as illustrated by the step in FIG. 7.

Figure 8:
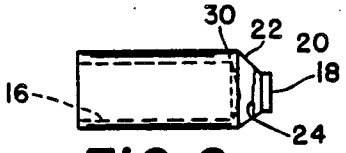
FIG. 8 is a view of the blank after being struck while in a die where the tip is extruded and the cylindrical bore extended.
Figure 9:
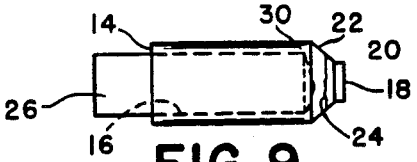
FIG. 9 is a view of the blank with a copper core inserted in the cylindrical bore.

Thereafter the blank 10 is transported to a die where a cup defined by bore 16 is formed and the tip of platinum 18 is extruded to produce the resulting component 30 shown in FIG. 8. During ths extrusion process, the platinum flows down the chamfer to completely cover the weld 20 as illustrated by the edge 24.

Figure 10:
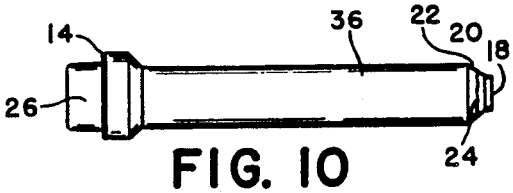
FIG. 10 is a view of the blank and copper core after a final extrusion operation.
Figure 11:
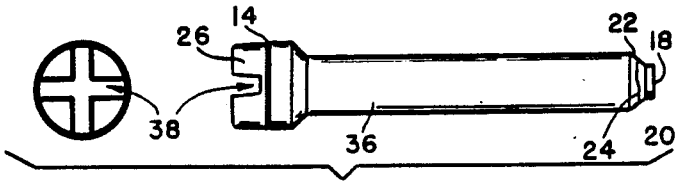
FIG. 11 is a view of the resulting electrode with a cross formed in the copper core.

After the component 30 has been formed, a copper core 26 is inserted into bore 16. The component 30 with the copper core 26 are transferred to a die and the center electrode assembly 36 is extruded to a desired length as shown in FIG. 10. During this extrusion, an excess of copper is formed over the top of the second 14 end to insure a completely filled bore 16. Thereafter a cross 38 is formed in the copper core 26 to produce a castle type head as shown in FIG. 11.

Figure 12:
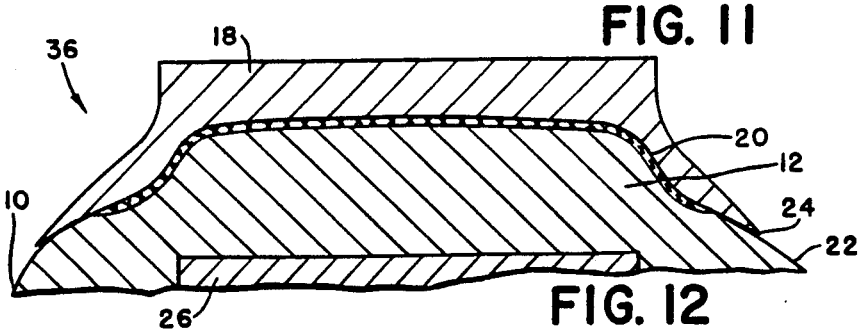
FIG. 12 is a sectional view showing the platinum tip which extends down the chamfer to protect the weld between the platinum tip and inconel body.

A center electrode 36 manufactured according to the process described above was cut to produce the sectional view shown in FIG. 12. As can be seen, the weld 20 is located along the end 12 of the inconel body 10. The edge 24 of the extruded platinum which flows down the chamfer 22 completely covers arc weld 20. Since the weld 20 will be protected from the environmental operating gases, an electrical flow path between the platinum tip 18 and copper core 26 through the end 12 of inconel body should be maintained.

I claim:

1. A method of manufacturing an electrode for a spark plug comprising the steps of:

cutting a piece of inconel wire from a source to define a cylindrical blank member having a first end and a second end;

extruding said cylindrical blank to define a central opening that extends from said second end toward said first end;

welding a strip of platinum to said first end;

chamfering said first end to remove any platinum and weld flash that may have been produced during said welding;

forming an extruded tip that extends from said first end such that platinum extends along the chamfered surface to completely cover said weld;

inserting a copper member into said central opening; and further extruding said cylindrical blank and copper member to define a finished length for said electrode, establishing a mechanical bond between said copper member and cylindrical blank such that an electrical conductive path is producd between said tip through said blank member into said copper member.

2. The method of manufacturing an electrode as recited in claim 1 further including the step of:

squaring said first end of said blank member to prepare said first end for receipt of said strip of platinum.

3. The method of manufacturing an electrode as recited in claim 2 further including the step of:

cleaning said blank member to remove any residue from said first end that may adversely effect said weld.

4. The method of manufacturing an electrode as recited in claim 3 further including the step of:

cleaning said blank member after chamfering to assure that any metal particles are removed from the central opening.

5. The method of manufacturing an electrode as recited in claim 4 further including the step of:

forming a head on said copper member, said head member providing a contact surface through which electrical energy is transmitted from a source to said extruded tip.

6. A process for manufacturing an electrode for a spark plug comprising the steps of:

cutting a blank from a source of inconel wire;

squaring said blank to establish a flat surface on at least a first end thereof;

cleaning said blank to remove any contaminates that may have been placed on said flat surface;

welding a strip of platinum to said flat surface;

chamfering said first end to remove a portion of said strip of platinum and weld flash to produce a substantially circular platinum tip on said first end;

inserting said blank in a die; and striking said blank to cause said platinum to flow down said chamfers and cover the weld surface between said platinum tip and the flat surface on the inconel blank to provide protection for the weld surface when exposed to a corrosive environmental condition.

7. The process as recited in claim 6 for manufacturing an electrode for a spark plug further including the steps of:

inserting said blank into a cup die; and striking said blank to produce a central cylindrical opening that extends from a second end toward said first end.

8. The process as recited in claim 7 for manufacturing an electrode for a spark plug further including the steps of:

placing a copper member in said central cylindrical opening;

inserting said blank member and copper member in a die; and striking said blank member causing said blank to be extruded to a desired length.

9. The process as recited in claim 8 for manufacturing an electrode for a spark plug further including the step of forming the copper over the top of the second end to insure a completely filled central cylindrical opening.

10. The process as recited in claim 9 for manufacturing an electrode for a spark plug further including the step of:

forming said second end to establish a cross shaped castle head.

11. The product produced by the process recited in claim 10.

* * * * *